US006658309B1

(12) United States Patent
Abrams et al.

(10) Patent No.: US 6,658,309 B1
(45) Date of Patent: Dec. 2, 2003

(54) SYSTEM FOR PRODUCING SOUND THROUGH BLOCKS AND MODIFIERS

(75) Inventors: Steven R. Abrams, New City, NY (US); Daniel V. Oppenheim, Corton-on-Hudson, NY (US); Donald P. Pazel, Montrose, NY (US); James L. Wright, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 08/976,147

(22) Filed: Nov. 21, 1997

(51) Int. Cl.[7] ..... G10H 7/00

(52) U.S. Cl. ..... 700/94; 84/609; 84/645; 84/649

(58) Field of Search ..... 84/603, 604, 609, 84/610, 645, 649

(56) References Cited

U.S. PATENT DOCUMENTS 4,960,031 A * 10/1990 Farrand ..... 84/462
5,728,962 A * 3/1998 Goede ..... 704/278
5,753,844 A * 5/1998 Matsumoto ..... 434/307 A
5,756,916 A * 5/1998 Aoki et al. ..... 84/609
5,770,812 A * 6/1998 Kitayama ..... 84/603
5,952,598 A * 9/1999 Goede
5,990,404 A * 11/1999 Miyano

OTHER PUBLICATIONS

Cointe, Pierre; Rodet, Xavier, "Formes: an Object & Time Oriented System for Music Composition and Synthesis", 1984, pp. 85–95.*

Oppenheim, Daniel V. "DMIX—A Mutli Faceted Environment for Composing and Performing Computer Music: its Design, Philosophy, and Implementation".*

* cited by examiner

*Primary Examiner*—Forester W. Isen
*Assistant Examiner*—Brian Pendleton
(74) *Attorney, Agent, or Firm*—Stephen C. Kaufman, Esq.; McGinn & Gibb, PLLC

(57) ABSTRACT

The present invention discloses a computer system adapted for composing sound. Sound is composed via a combination of blocks and modifiers, where a block is an abstraction of a collection of data that, when processed by appropriate algorithms and hardware, produces sound. Further, the current invention also comprises one or more modifiers, each of which, when applied to a block, alters the sound produced by that block.

29 Claims, 5 Drawing Sheets

SYSTEM FOR PRODUCING SOUND THROUGH BLOCKS AND MODIFIERS

BACKGROUND OF THE INVENTION

This invention relates to a system and method for composing sound.

INTRODUCTION TO THE INVENTION

Creating music with computers began in the early 1960s with Max Mathews of Bell Labs. He devised a family of computer programs to compose music, of which the best known is MUSIC V. This program consisted of two main components: an Orchestra and a Score. The Orchestra comprised a collection of synthesis algorithms that were used to obtain different sounds, such as flute, violin, or drums. The Score was a list of time-tagged parameters that specified each note to be played by each instrument. The MUSIC V Score modeled a conventionally-notated musical score—in fact, in many cases a conventional score was automatically translated into a MUSIC V score. MUSIC V scores were not graphical and were created using a text editor. Because the underlying representation was as general as conventional musical notation, the assumption was that MUSIC V-type programs could be used to generate almost any type of music. However, these programs were available only on large and expensive mainframe computers, to which few people had access. Also, just as it requires a professional musician to compose music using musical notation, it required a professional musician to create a MUSIC V score.

Recent technological advances provide anyone who has access to a computer with the potential for high-end music composition and sound production. These technologies include MIDI (Musical Instrument Digital Interface), inexpensive commercial synthesizers, standard multimedia sound cards, and real-time software engines for sound synthesis and audio processing. Work on new technologies and standards, such as DLS (DownLoadable Sounds), high speed networks, the Internet, and computer game technologies, suggests that this potential will continue to expand on a rapid scale. In the near future, these new technologies will bring to the consumer market a potential for high-end state of the art composing and sound production that today is available only to professionals.

SUMMARY OF THE INVENTION

Despite the fact that there has been a significant advance in technology, it is still very difficult for a person not highly skilled as a musician to compose music using computers. The present invention enables non-musicians to effectively compose music using a computer, and provides them with the means to have complete control of the compositional process and the musical outcome. This result is accomplished through the interaction of what we call blocks and modifiers.

The present invention may be described as a computer system adapted for composing sound. Sound is composed via a combination of blocks and modifiers, where a block is an abstraction of a collection of data that, when processed by appropriate algorithms and hardware, produces sound. Further, the current invention also comprises one or more modifiers, each of which, when applied to a block, alters the sound produced by that block.

The invention falls into two overlapping domains: music composition and sound editing. The invention is a computer software application that uses models of sound events, such as musical notes or digital representations of sounds (e.g., WAV files). A collection of these sound events models a complex event, such as a musical phrase. Further nesting of these events into hierarchies can indicate the structure of the sound event, such as sections or movements of a piece of music. Each of these collections, in our system, is referred to as a block. One unique aspect of our system is that these blocks are modeled as software objects that can be manipulated by the computer system in the same manner as basic events in other systems. Further, blocks can be grouped together and nested in arbitrary hierarchies. Any such grouping of blocks can be manipulated in the same manner as an individual block. A further unique aspect of our system is the capability to apply modifiers to blocks. These modifiers are also modeled as software objects that can be applied to a block, thereby changing the sound ultimately produced by that block.

In one aspect, the present invention comprises a computer system adapted for sound applications including:

1) two or more blocks, each of which blocks comprise a collection of data, each of the blocks independently referenced to a common temporal framework;
2) means for containing a block in an arbitrary number of nested aggregates of blocks;
3) means comprising an algorithm and hardware for processing the data contained within a block for generating a corresponding sound;

and 4) one or more modifiers, each of which modifiers can be applied to a block, causing a modification to the corresponding sound.

BRIEF DESCRIPTION OF THE DRAWING

The invention is illustrated in the accompanying drawing, in which.

DETAILED DESCRIPTION OF THE INVENTION

In order to illustrate and set off the present invention from background concepts of interest, we first reference exemplary prior art applications and materials. One illustrative type is set out in FIG. 1, numeral 10.

Applications that use a Higher-level Representation of a Block

Some of these applications use a higher level representation of a block, but their use of a block is distinctly different from the current invention. These applications include:

Vision (Opcode)

CakeWalk(Twelve Tone Systems)

Logic Audio (E-Magic)

ProTools(DigiDesign)

FreeStyle and Performer (Mark of the Unicorn)

DoReMix (Roland)

Yamaha Visual Arranger

Some systems (such as DoReMix and Visual Arranger) use a feature similar to a block for grouping and arranging data, but permit no modifications to that data at all. That is, blocks are used for temporal arrangement of data representing chunks of sound, and that is all.

Figure 1:
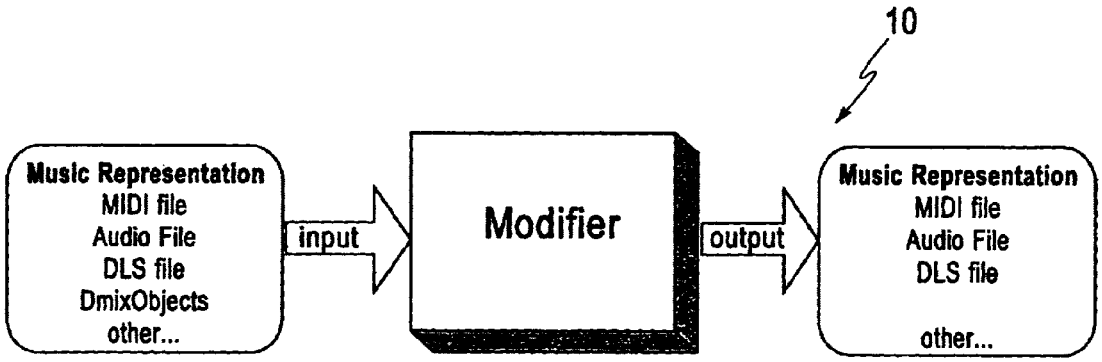
FIG. 1 illustrates a traditional Use of Blocks and Modifiers.

Some of these systems (such as CakeWalk) use a feature that simulates a block, but this block structure is a temporary device, used only for selecting data to make a one-time edit. For example, FIG. 1 illustrates a traditional use of blocks and modifiers in computer music systems. In systems such as this a block is perhaps better described as a selection, which is a grouping of events (i.e., notes) done to perform a specific operation. The selection or block does not persist beyond the operation at hand; the grouping of events into a block is transient.

Other more advanced systems such as ProTools and Logic Audio use blocks for grouping and arranging data in tracks. Again, one-time edits can be made to the data contained in a block but modifiers can only be applied to a track as a whole, and not to individual blocks.

Our invention is fundamentally different. A block as used in our invention hides the individual notes and enables the user to work on a higher level. This process is similar to the computer drawing program Visio, where the user picks graphical primitive objects, such as a rectangle, from a palette and places them on a canvas. Visio provides users with palettes of complex, pre-composed visual objects, which the user can use to assemble a collage of smart shapes that know how to fit together. The application treats the collage as a Visio drawing, which the user can nest inside another Visio drawing.

In the current invention, a block is similar to a complex visual object; our block is a primitive software object like the graphical objects in Visio are primitive software objects. A block in the current invention persists beyond the performance of a specific operation. A block is a musical representation made out of a collection of nested blocks. It is the blocks, rather than individual events, that are the components out of which the final result (i.e., the sound/music produced) is built. The use of blocks and modifiers enables the construction of high-level, intuitive tools that will enable even a naive user to have advanced control over the sound and to change it until it sounds exactly as desired.

Definition of a Block

A block is a software data structure comprising a collection of data, such as other blocks, MIDI data, or digital audio. Each block has associated information:

- a list of events that are required by the play function to produce sounds. This list is known as the data list. Examples of data include MIDI data, digital audio, wave audio, note events, or control events.
- a list of the blocks that are contained in this block. This list is important in determining the temporal order in which the blocks are played.
- an ordered list of the modifiers that have been applied to the block.
- a list of the blocks that contain this block in an aggregated nesting, also knows as the containing list. In our embodiment, the first element in this list identifies the parent block of this block; the parent block has special significance for playback.

In addition, each block has a set of associated attributes, including:

- the onset of the block. The onset is the time at which the block should be played by the player function. The onset can be expressed either in units of-absolute time (e.g., 5 seconds after the beginning of the score) or in musical terms (e.g., bar 5, beat 3). Each block's onset is defined in reference to its parent block's onset.
- the duration or the length of time the block should be played. The duration can be expressed either in units of absolute time or in musical terms.
- the loudness at which the block should be played.
- the pan position (i.e., the balance: left or right).
- the equalization that should be applied to the block.
- name.
- instrument.
- comment.
- an algorithm that produces sound from the block's data (i.e., the play function).

The play function is a function that takes a block as an argument and produces sound. The function takes into account the data, the block's attributes, the list of modifiers that have been applied to the block, and the collection of all the modifiers that have been applied to other blocks that contain it.

Figure 2:
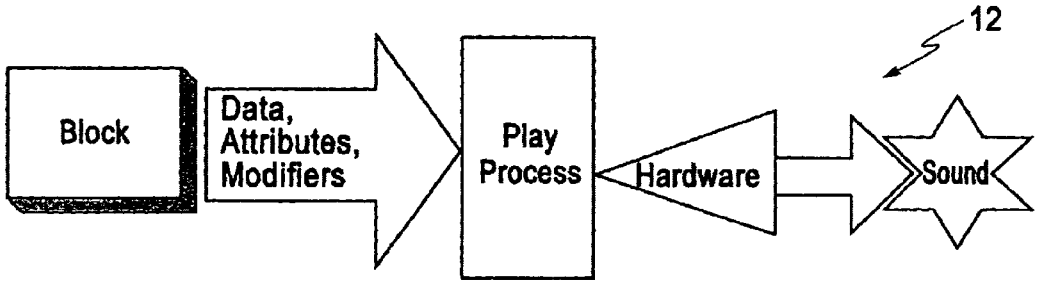
FIG. 2 illustrates a Playback Function.

The playback of a sound is illustrated in FIG. 2, numeral 12.

Nesting of Blocks

Figure 3:
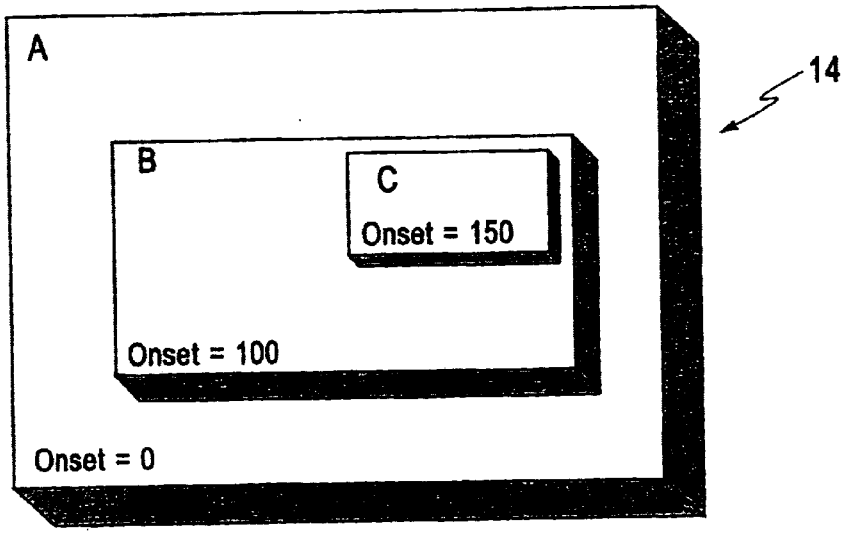
FIG. 3 shows Block Containment.

The list of containing blocks (i.e., the containing list) is the information that enables the aggregation and nesting of blocks. For example, suppose we have a block A that contains a block B, which in turn contains a block C, as illustrated in FIG. 3, numeral 14:

An algorithm preferably used by the current invention to determine the order in which to play the blocks is a recursive algorithm. The algorithm takes a block, examines its list of all of the blocks it contains, and schedules each subsidiary block for playback based on each block's onset. (Every block's onset is defined in reference to its parent block's onset.)

Figure 4:
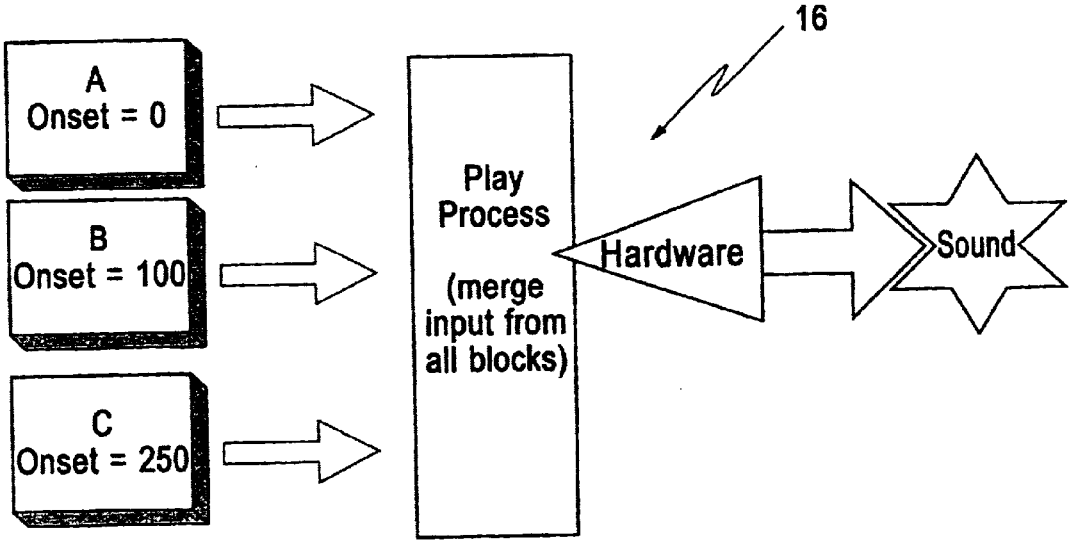
FIG. 4 shows Playback of Nested Blocks.

For example, the MIDI data inside a block must be scheduled at the time of the event plus the time of that block's onset. FIG. 4, numeral 16, demonstrates how this would be applied to the blocks illustrated in FIG. 3. The algorithm looks inside block A at T0 (Onset=0), sees that the block has MIDI events plus nested blocks, and schedules each block for processing by the play function at the designated time. As shown in FIG. 4, the designated time is computed by adding the onset of each nested block to the onset of its parent block:

The first element in each block's containing list identifies the upper, containing, block, called the parent block. The parent block is important for determining the onset time and therefore temporal order of playback. Subsequent entries on the containing list are used to determine the application of modifiers to the block. These entries do not in themselves affect the temporal order of playback.

Figure 5:
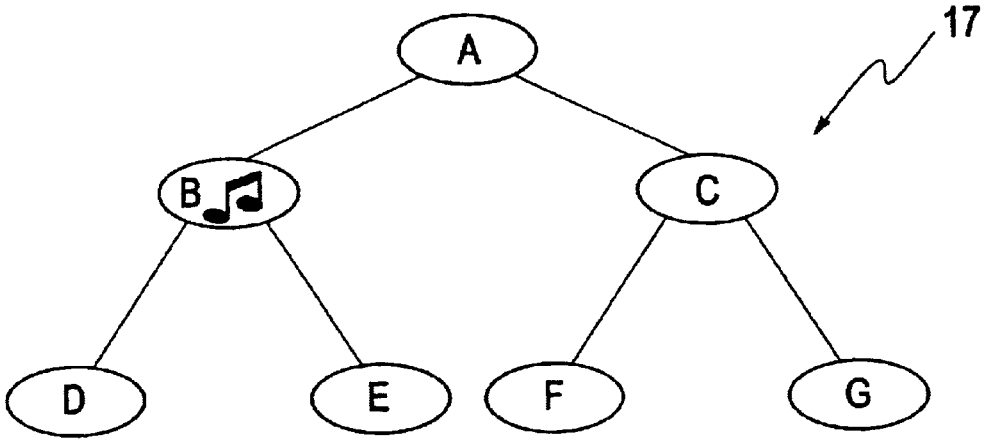
FIG. 5 provides an example 1 of Nested Blocks using Tree Format.
Figure 6:
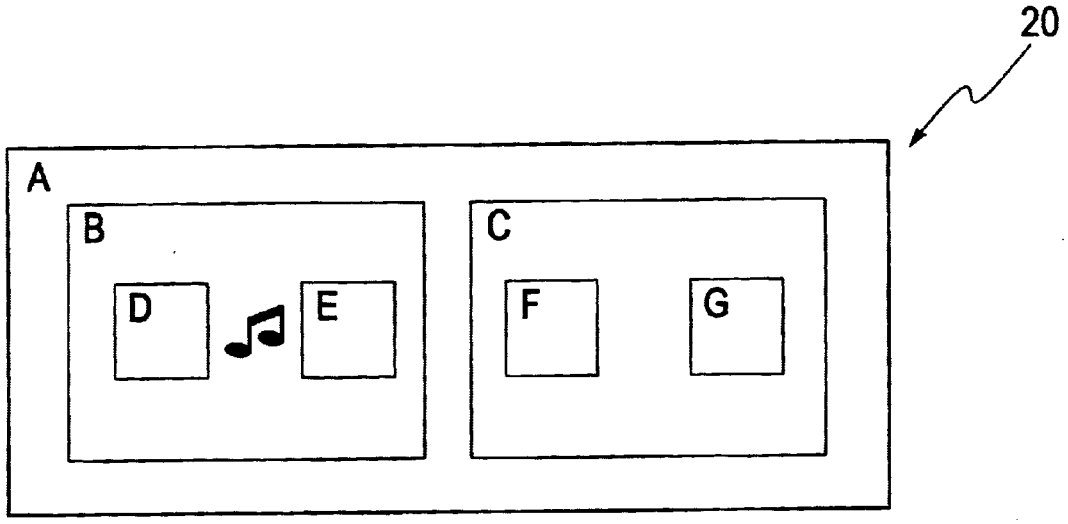
FIG. 6 provides an example 1 of Nested Blocks using Graphical Format.

FIG. 5, numeral 18, presents an example of a group of nested blocks in a tree format. FIG. 6, numeral 20, shows the same nesting hierarchy in a graphical format. Note that block B contains both blocks (D and E) and individual musical note data.

For each block in FIG. 5 and FIG. 6, Table 1 presents the block's containing list, the list of blocks contained in it, and its parent block.

TABLE 1

Data for Example 1

| BLOCK | CONTAINS | CONTAINED IN | PARENT BLOCK |
|---|---|---|---|
| A | B, C | empty | empty |
| B | D, E | A | A |
| C | F, G | A | A |
| D | empty | B | B |
| E | empty | B | B |
| F | empty | C | C |
| G | empty | C | C |

Figure 7:
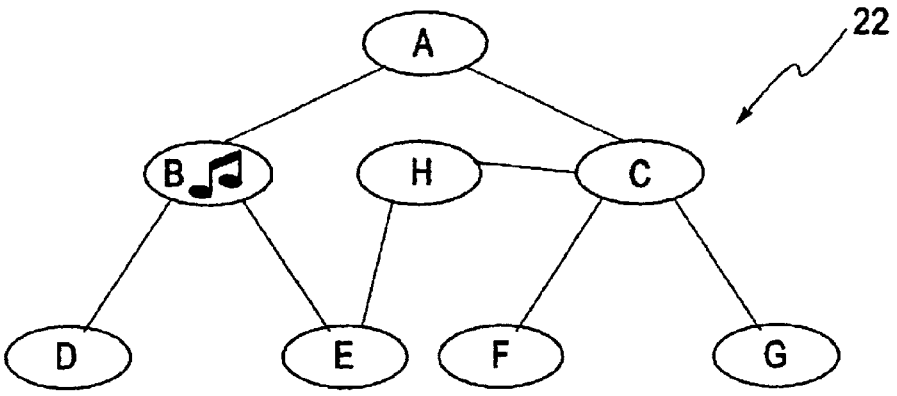
FIG. 7 provides an example 2 of Nested Blocks using Tree Format.
Figure 8:
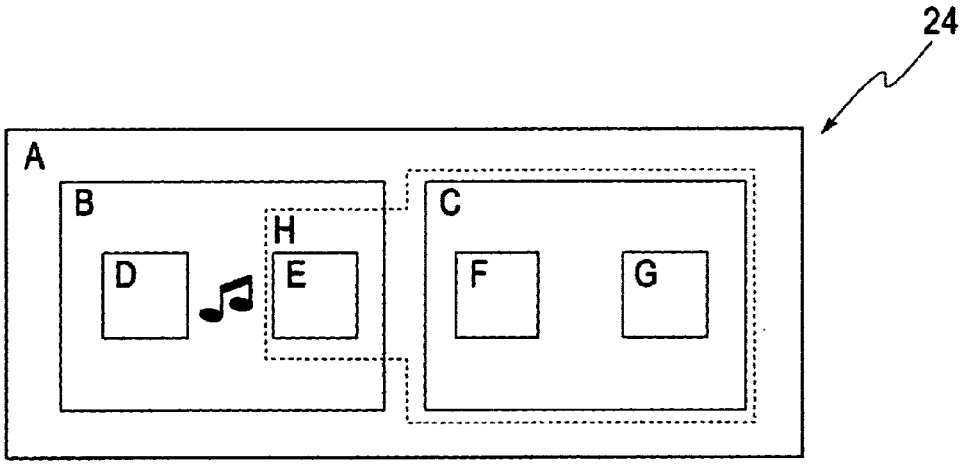
FIG. 8 provides an example 2 of Nested Blocks using Graphical Format.

Now suppose we introduce one more block, block H, as illustrated in FIG. 7, numeral 22, and FIG. 8, numeral 24. The data in Table 1 changes to incorporate the nesting introduced by block H, as shown in Table 2.

Blocks such as block H are only used for the purpose of aggregating the application of modifiers, not for determining the temporal order of playback. The data in Table 1 changes to incorporate the nesting introduced by block H, as shown in Table 2.

TABLE 2

Data for Example 2

| BLOCK | CONTAINS | CONTAINED IN | PARENT BLOCK |
|---|---|---|---|
| A | B, C | empty | empty |
| B | D, E | A | A |
| C | F, G | A, H | A |
| D | empty | B | B |
| E | empty | B, H | B |
| F | empty | C | C |
| G | empty | C | C |
| H | C, E | empty | empty |

Block H does not appear on any other block's containing list (and therefore has no parent block), and is never first on any other block's contained in list. Block H is also never passed to the playback function, because it's purpose is entirely for the aggregate application of modifiers.

Definition of a Modifier

A modifier is a software algorithm. The current invention has two types of modifiers: eager, and lazy.

An eager or early modifier is an algorithm that knows how to modify the data contained in a block directly. An eager modifier is also called a destructive modifier because it actually changes the data in the block. For example, a chromatic transposition modifier, when applied as an eager modifier to a block containing MIDI data, changes the pitch value of all the notes in the block to effect the requested transposition. If data is added to a block after an eager modifier has been applied to the block, the modifier will change the new data in precisely the same way it changed the original data.

A lazy or late modifier doesn't necessarily know the internal data structure of a block, but knows how to interface with the play function and act as a filter on the block's data while it is being played. A lazy modifier does not alter the actual data in a block but only affects the way it sounds when interpreted by the play function. For example, a chromatic transposition modifier, when applied as a lazy modifier to a block containing MIDI data, cause the pitch produced by the play function to be altered by the requested transposition. The MIDI data contained in the block is not affected.

Applying Modifiers to Aggregated Blocks

Each block has a list of the modifiers, both eager and lazy, that have been applied to it. A significant aspect of the current invention is the ability to determine which modifiers are applied to which blocks, in which order. The order in which the modifiers are applied to a block will change the way the block sounds when it is passed to the play function. The aggregation of the data in the blocks, and the mechanisms that can apply modifiers to any level within that aggregation, comprise a unique aspect of the invention.

Lazy modifiers can be chained together, so that the output of one modifier can be connected to the input of another modifier, producing a cascading effect. A modifier takes data from a block as input and produces an output, which is then chained to the input of another modifier, and so on, until the final output is passed to the play function to produce sound.

Figure 9:
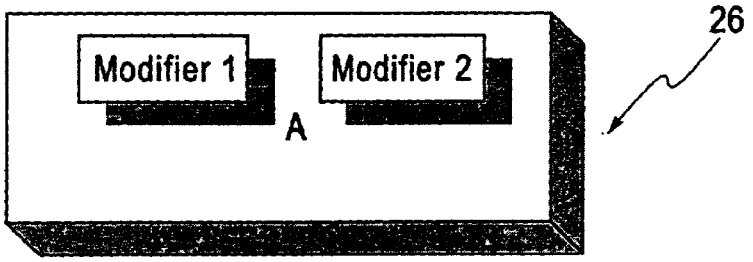
FIG. 9 illustrates Applying Modifiers to Blocks.

In FIG. 9, numeral 26, two modifiers have been applied to block A and are contained in the block's modifier list. These two modifiers change some aspect of block A's data (e.g., pitch), attributes (e.g., pan or instrument), or any combination of data and attributes.

Figure 10:
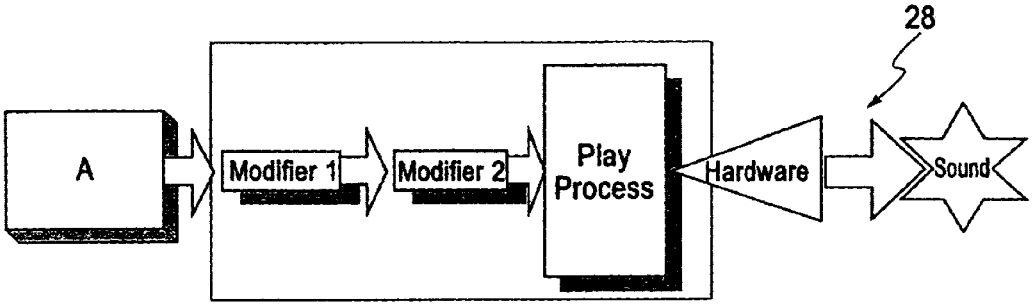
FIG. 10 illustrates Playing a Block with its Modifiers Applied.

During playback, our representative embodiment applies these modifiers (if they are lazy, not eager), as demonstrated in FIG. 10, numeral 28.

Determining the Order in Which to Apply Modifiers to Nested Blocks

The order in which the modifiers are applied to the blocks in an arbitrary nesting can have significant impact on the way in which the sound is rendered. Therefore, it is important that the system provides a mechanism that guarantees that a consistent, predictable ordering is used. A number of alternatives exist; the algorithm used by the current invention to identify all the modifiers applied to a block and determine the correct order in which to apply them is a recursive algorithm. The algorithm takes a block, examines its list of modifiers and list of containing blocks, and determines the order in which to apply the modifiers.

The processing of the play function enables the lazy modifiers to change the behavior of the playback function as the data is passed through it. The algorithm is recursive because it must process each block not only by its own chain of modifiers, but also by the chain of modifiers of the block(s) that contain it, and by all the blocks on its parent block's list of containing blocks, and so on.

In our representative embodiment:

The order of the modifiers of each block is the order in which they were applied.

The user interface enables the user to change this ordering for each block.

The correct ordering of the modifiers is adjusted automatically in relation to all the containing blocks.

Figure 11:
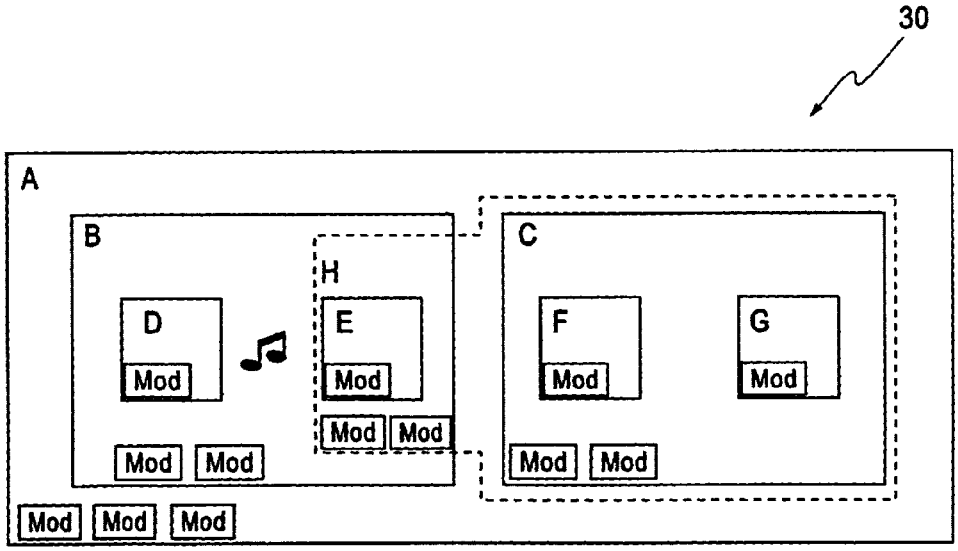
FIG. 11 provides an Example 2 with Modifiers Added.

For example, FIG. 11, numeral 30, illustrates the same block structure as was illustrated in FIG. 8 with the addition of one or more modifiers for every block.

The algorithm that determines the order in which to play the blocks examines the list of containing blocks, from A to G (top-down in the tree format), to determine the order of playback. First, note that each block has at most one parent block. That means that all blocks can be arranged in one or more directed acyclic graphs (or trees). The root node of each tree will be a block not contained in any other block (i.e. a block with no parent block. Each block is scheduled for playback recursively.

That is, each root node is scheduled for playback. When a block B is scheduled for playback, the blocks contained within it are also scheduled for playback relative to the playback time of B.

When a scheduled block is actually played back, the modifiers are applied to each block in an order determined using the following procedure:

For each block (for example, block D), the algorithm examines its list of modifiers ($m_D$) and applies these modifiers in the user-specified order. (In our representation, block D's modifiers are applied to block D, the first block to be played.)

The algorithm then examines block D's containing list and applies the modifiers of the block(s) on that list in the order of the list. (In our representation, block B's modifiers ($m_B$) are applied to block D in this step.)

For each block on D's containing list, the algorithm continues to examine the containing list of the next level block. (In our representation, block A's modifiers are applied to block D's data.)

When the algorithm reaches the top-level block (i.e., the containing list is empty), it moves to the next data or block to be played and repeats this procedure. (In our representation, block B's modifiers are applied to the note events in block B.)

The following notation, read from left to right, indicates the order in which the modifiers are applied and the blocks are played in the example illustrated in FIG. 11:

$(m_A(m_B(m_D(D))))\rightarrow(m_A(m_B(\text{notes})))\rightarrow(m_A(m_H(m_B(m_E(E)))))$ $(m_H(m_A(m_C(M_F(F)))))\rightarrow(m_H(m_A(m_C(m_G(G)))))\rightarrow\text{SOUND}$

What is claimed is:

1. A computer system adapted for sound applications, comprising:

a plurality of nested data blocks, each block comprising a collection of musical data and being independently referenced to a common temporal framework;

a processor for processing the musical data contained within said plurality of nested data blocks according to a predetermined algorithm, to generate a corresponding sound; and at least one modifier applied to a block in said plurality of nested data blocks, causing a modification to said corresponding sound, wherein said at least one modifier remains associated with said block after it is applied to said block.

2. A computer system according to claim 1, wherein a block to which a modifier has been applied is operated upon in the same manner as unmodified blocks.

3. A computer system according to claim 1, wherein a modifier is applied to aggregates of nested blocks.

4. A computer system according to claim 1, wherein said at least one modifier is not applicable to said block independently of other blocks in said plurality of nested blocks.

5. A computer system according to claim 1, wherein said at least one modifier is applicable to said block independently of other blocks in said plurality of nested blocks.

6. A computer system according to claim 1, wherein the data contained in a block comprises a representation of musical data comprising MIDI events.

7. A computer system according to claim 1, wherein the data contained in a block comprises a representation of musical data comprising digital audio.

8. A computer system according to claim 1, wherein the data contained in a block comprises a representation of musical data comprising a combination of digital audio and MIDI events.

9. A computer system according to claim 1, wherein with individual musical data not contained in any block, said data still contributes to production of sound.

10. A computer system according to claim 1, wherein the blocks comprise instructions for algorithmically generating data.

11. A computer system according to claim 1, wherein said at least one modifier takes one or more blocks as input and produces a new block.

12. A computer system according to claim 1, wherein said at least one modifier is part of a block, thereby enabling said block with a self-modification capability.

13. A computer system according to claim 1, wherein said at least one modifier comprises a plurality of modifiers that are applied to said block in an order that is automatically determined by the system in a manner consistent with the nesting of each block.

14. A computer system according to claim 1, wherein said at least one modifier comprises a plurality of modifiers, and wherein the ordering of modifiers that are applied to said block is determined by a user.

15. A computer system according to claim 1, wherein said at least one modifier comprises a nondestructive modifier which does not alter data in said data block.

16. A computer system according to claim 1, wherein data in said block before said at least one modifier is applied to said block, and data added to said block after said at least one modifier is applied to said block, are modified in a same manner.

17. A computer system according to claim 1, wherein said at least one modifier comprises a plurality of modifiers such that an output of a modifier is connected to an input of another modifier to produce a cascading effect.

18. A computer system according to claim 1, wherein said at least one modifier comprises a software object.

19. A computer system according to claim 1, wherein said plurality of blocks are represented graphically in a computer system and can be arranged via a graphical user interface to control temporal aspects of their playback.

20. A computer system according to claim 19, wherein said graphical user interface allows for the application of modifiers to said block.

21. A computer system according to claim 19, wherein said at least one modifier is graphically represented in a computer system for applying to graphical representations of blocks via a graphical user interface.

22. A computer system according to claim 19, wherein graphical manipulation of the data is used to determine inclusion of said data in one or more blocks.

23. A computer system adapted for sound applications, comprising:

a plurality of data blocks, configured as a nested aggregate, each data block comprising a collection of musical data and being independently referenced to a common temporal framework;

a processor for processing the musical data contained within a data block according to a predetermined algorithm, to generate a corresponding sound; and at least one modifier applied to a data block in said plurality of data blocks, for causing a modification to the corresponding sound, wherein said at least one modifier remains associated with said block after it is applied to said block.

24. The computer system according to claim 23, wherein said musical data comprises at least one of digital audio and MIDI events.

25. A method for producing sound through blocks and modifiers, said method comprising:

providing a plurality of nested data blocks, each data block comprising a collection of musical data and being independently referenced to a common temporal framework;

processing said musical data according to a predetermined algorithm, to generate a corresponding sound; and applying at least one modifier to a block in said plurality of nested data blocks, to modify said corresponding sound, wherein said at least one modifier remains associated with said block after it is applied to said block.

26. A method according to claim 25, wherein a block to which said at least one modifier has been applied is operated upon in the same manner as unmodified blocks.

27. A method according to claim 25, wherein said at least one modifier is applied to aggregates of nested blocks.

28. A method according to claim 25, wherein said at least one modifier is not applicable to said block independently of other blocks in said plurality of nested blocks.

29. A method according to claim 25, wherein said at least one modifier is applicable to said block independently of other blocks in said plurality of nested blocks.

* * * * *